US011566205B2

(12) United States Patent
Hughes, Jr.

(10) Patent No.: US 11,566,205 B2
(45) Date of Patent: Jan. 31, 2023

(54) ANIMAL-SCENTED COMPOUND FOR HUNTING AND TRAINING, METHOD OF MAKING, AND COMPOUND-LOADED DEVICES

(71) Applicant: Glenn D. Hughes, Jr., Stovall, NC (US)

(72) Inventor: Glenn D. Hughes, Jr., Stovall, NC (US)

( * ) Notice: Subject to any disclaimer, the term of this patent is extended or adjusted under 35 U.S.C. 154(b) by 107 days.

(21) Appl. No.: 17/316,151

(22) Filed: May 10, 2021

(65) Prior Publication Data

US 2022/0356415 A1 Nov. 10, 2022

(51) Int. Cl.
*C11B 9/00* (2006.01)

(52) U.S. Cl.
CPC ..... *C11B 9/00* (2013.01)

(58) Field of Classification Search
None
See application file for complete search history.

(56) References Cited

U.S. PATENT DOCUMENTS 3,956,173 A 5/1976 Towle
4,318,746 A 3/1982 Claffey et al.
4,851,394 A * 7/1989 Kubodera ..... A22C 13/0013 426/138
5,916,552 A 6/1999 Perry
6,231,849 B1 * 5/2001 Schiller ..... A01N 43/36 514/408
6,632,786 B1 10/2003 Wyatt
2020/0323759 A1 * 10/2020 Mishina ..... A61K 8/042

* cited by examiner

*Primary Examiner* — Arrie L Reuther
(74) *Attorney, Agent, or Firm* — NK Patent Law

(57) ABSTRACT

A scented compound is configured to release a scent of a target animal. The compound includes glucomannan, carrageenan, water, an animal-sourced additive, and glycerine. The scented compound undergoes syneresis thereby releasing over time at least a portion of the animal-sourced additive. The animal-sourced additive is preferably the only animal-sourced ingredient of the compound. The scented compound preferably does not contain gelatin. The animal-sourced additive may be urine. The animal-sourced additive may be blood. The compound is targeted toward a particular type of animal by inclusion of a specific animal-sourced additive. The compound is useful for attracting the targeted specific animal for hunting and/or game observation and tracking, and for use in training hunting dogs, for example when loaded into a ball. Other than the animal-sourced additive, the scented compound and its ingredients are free of gelatin, which is a collagen taken from animal body parts.

15 Claims, 3 Drawing Sheets

ANIMAL-SCENTED COMPOUND FOR HUNTING AND TRAINING, METHOD OF MAKING, AND COMPOUND-LOADED DEVICES

TECHNICAL FIELD

The present disclosure relates to scented materials for luring wild game and training hunting dogs. More particularly, the present disclosure relates to a product compound that is semi-rigid and deformable and actively reacts to outdoor exposure by syneresis or "sweating" thereby releasing an a specific animal-sourced additive.

BACKGROUND

Hunters sometimes use scents to lure wild game as well as to conceal their odors from a target animal's detection. Animal sourced products such as urine can be used to attract a particular animal type as attracted animals seek each other or evidence of their presence for mating or for contesting territory. A lure material may dissipate quickly in outdoor conditions, and so a hunter may need to return to an area of interest to replenish a scented area with lure material.

In some cases, soluble solids are used with an attractant ingredient to stabilize the lure material for longer times of effect in the wild. In outdoor conditions, where the solids are exposed to rain and ground moisture, the attractant ingredient is released over time, thus increasing the time of the effect of the treatment intended by the hunter. Typical such solids include traditional polysaccharides (gelatin), which may alert target animals due to ingredients in the gelatin that are byproducts of animals other than those sought by hunters and can have an unwanted scent accordingly. Such non-target animal byproducts can also be detrimental to the training of scent-tracking animals.

SUMMARY

This summary is provided to briefly introduce concepts that are further described in the following detailed descriptions. This summary is not intended to identify key features or essential features of the claimed subject matter, nor is it to be construed as limiting the scope of the claimed subject matter.

In at least one embodiment, a product includes a scented compound configured to release a scent of a target animal. The compound includes glucomannan, carrageenan, water, an animal-sourced additive, and glycerin.

The scented compound, when exposed to additional moisture, may undergo syneresis thereby releasing at least a portion of the animal-sourced additive.

The animal-sourced additive is preferably the only animal-sourced ingredient of the compound.

The scented compound preferably does not contain gelatin.

The animal-sourced additive may be urine.

The animal-sourced additive may be blood.

The product may further include a ball into which the scented compound is loaded for hunting-animal training use.

In at least one embodiment, a method of making a scented compound includes combining glucomannan, carrageenan, water, an animal-sourced additive, and glycerin.

Combining glucomannan, carrageenan, water, an animal-sourced additive, and glycerin may include: combining glucomannan and carrageenan to form a powder mixture; combining and heating water, animal-sourced additive, and glycerin to form a heated liquid mixture; and combining the powder mixture and heated the liquid mixture to form a heated compound.

The heated compound is preferably mixed to uniformity.

The heated compound may be boiled.

The compound is preferably heated until viscous and uniformly colored.

The heated compound may include about: 5 to 7 parts by volume konjac root glucomannan; 8 to 10 parts by volume kappa carrageenan; 46 to 48 parts by volume water; 23-25 parts by volume urine; and 13-15 parts by volume glycerine.

The above summary is to be understood as cumulative and inclusive. The above described embodiments and features are combined in various combinations in whole or in part in one or more other embodiments.

BRIEF DESCRIPTION OF THE DRAWINGS

The previous summary and the following detailed descriptions are to be read in view of the drawings, which illustrate particular exemplary embodiments and features as briefly described below. The summary and detailed descriptions, however, are not limited to only those embodiments and features explicitly illustrated.

DETAILED DESCRIPTIONS

Figure 1:
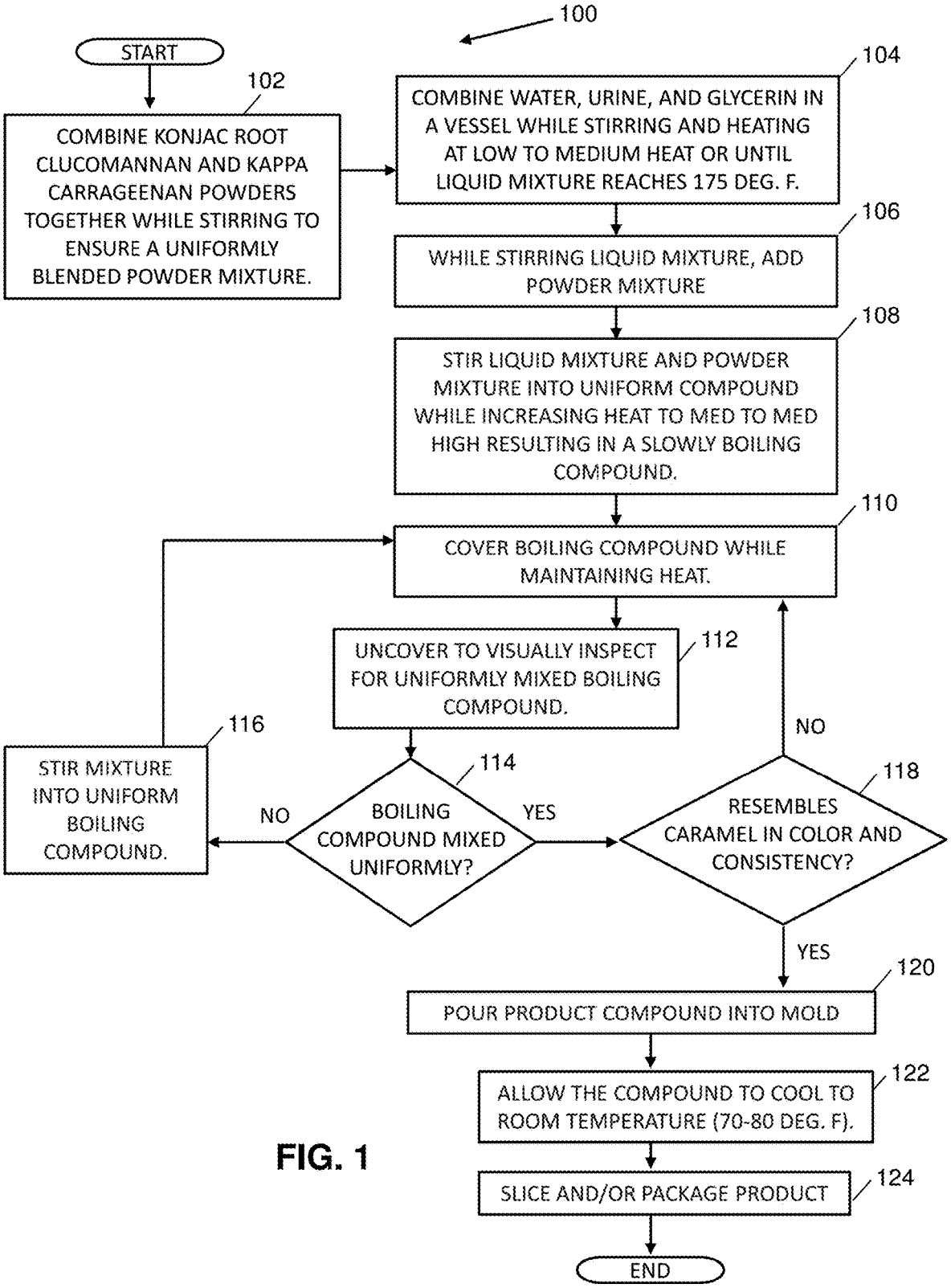
FIG. 1 is a flow chart representing a method of making a scented compound for attracting a specific animal, according to at least one embodiment.

These descriptions are presented with sufficient details to provide an understanding of one or more particular embodiments of broader inventive subject matters. These descriptions expound upon and exemplify particular features of those particular embodiments without limiting the inventive subject matters to the explicitly described embodiments and features. Considerations in view of these descriptions will likely give rise to additional and similar embodiments and features without departing from the scope of the inventive subject matters. Although steps may be expressly described or implied relating to features of processes or methods, no implication is made of any particular order or sequence among such expressed or implied steps unless an order or sequence is explicitly stated.

Any dimensions expressed or implied in the drawings and these descriptions are provided for exemplary purposes. Thus, not all embodiments within the scope of the drawings and these descriptions are made according to such exemplary dimensions. The drawings are not made necessarily to scale. Thus, not all embodiments within the scope of the drawings and these descriptions are made according to the apparent scale of the drawings with regard to relative dimensions in the drawings. However, for each drawing, at least one embodiment is made according to the apparent relative scale of the drawing.

Like reference numbers used throughout the drawings depict like or similar elements. Unless described or implied as exclusive alternatives, features throughout the drawings and descriptions should be taken as cumulative, such that features expressly associated with some particular embodiments can be combined with other embodiments.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a," "an," and "the" refer to "one or more" when used in the subject specification, including the claims. Unless indicated to the contrary, the numerical parameters set forth in the instant specification and attached claims are approximations that can vary depending upon the desired properties sought to be obtained within the scope of these descriptions. As used herein, the term "about," when referring to a value or to an amount of mass, weight, time, volume, concentration, and/or percentage can encompass variations within a range, for example of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are within the scope of these descriptions. The term "about" can be used herein to specify a range, such as "about 10 to 20 parts by volume," which specifies a range with a lower bound of 10 parts by volume and an upper bound of 20 parts by volume.

A scented compound, methods of its making, and examples of it use, are described in the following with reference to the drawings. The compound is targeted toward a particular type of animal by inclusion of a specific animal-sourced additive, such as urine, or another additive sourced from an animal, such as blood, in the composition of the compound. The compound is useful for attracting the targeted animal for hunting and/or game observation and tracking, and for use in training hunting dogs. The animal-sourced additive in some examples is sourced from the target animal, as can be the case for hunting white-tail deer for example. The animal-sourced additive in some examples is sourced from an animal other than the target animal, as can be the case for competing predators. For example, the urine of wolves can attract coyotes.

A scented compound, according to at least one embodiment within these descriptions, includes all-natural ingredients, without chemical preservatives, and without non-target animal byproducts. Non-target animal byproducts, such as traditional polysaccharides (gelatin), may alert target animals or prove detrimental to the training of scent tracking animals.

The product compound is provided as a semi-rigid deformable polymer in its ready-for-use state. The compound is designed to actively react to outside temperature changes and weather variations by way of syneresis or "sweating." Plasticizer compositions can be adjusted to achieve longer or shorter durations of syneresis dependent on desired applications.

When used in hunting applications, such as in wild game animal territory marking, the product compound can be used in a mimic scrape placed in a target location known to have the presence of the target animal. A scrape is typically a bare patch of ground shaped like an oval or triangle where a territorial animal, such as a deer, has pawed away small plant growth, leaves, and other natural debris to expose soil. The animal typically urinates on the exposed soil area to leave its scent. An active scented scrape may establish territory and attract mates. An animal that prepares a scrape may return to refresh the scent with fresh urine and to learn whether others, for example competing males, have also scented the scrape.

A product unit of a scented compound according to these descriptions can be placed just beneath the soil cover in the making of mimic scrape. Due to exposure, the product will "sweat" the animal-specific animal-sourced additive, such as urine, which will be wicked into the soil. Outside conditions such as rain or the urine of another animal will act to rehydrate the compound for a time-release of the additive, until, over time, the complete dissolution of the compound into the dirt. This process can take over several weeks depending on both weather and soil conditions. Open air or dry conditions provide greater product longevity for any given unit amount of the compound.

Ingredients by volume useful for the making of an inventive animal scented compound, according to at least one embodiment, are provided in the listing below. The ingredients in the listing are indicated in two columns. The ingredients are firstly indicated by percentage (%) volume for use in scaling to any particular total combined volume. The ingredients are secondly indicated by gram (g) weight and/or milliliter (ml) for use in preparing a total combined volume of 85 ml. For the powder ingredients, Konjac Root Glucomannan and Refined Kappa Carrageenan, the indicated gram (g) weights corresponding to the listed given volumes (ml) is provided to promote accuracy.

| | | |
|---|---|---|
| Konjac Root Glucomannan | 6% (2.85 g or 5 ml of 85 ml) | Powder |
| Refined Kappa Carrageenan | 9% (2.85 g or 8 ml of 85 ml) | Powder |
| Water | 47% (40 ml of 85 ml) | Liquid |
| Pure Urine | 24% (20 ml of 85 ml) | Liquid |
| Glycerin | 14% (12 ml of 85 ml) | Liquid |

The above indications by % volume, gram weight, and by milliliter of 85 ml are provided as example and each may vary within the scope of these descriptions. Some loss of volume, due to evaporation for example particularly for the liquid ingredients, during the preparation of the product compound may occur. The above listing indicates the volumes (by percentage and by ml as described above) of the water, urine, and glycerin ingredients prior to heating, with reference to step 102 and step 104 of the method 100 as described below with reference to FIG. 1.

In FIG. 1, and in these descriptions thereof, urine serves as a specific animal-sourced additive by which the resulting product compound is targeted toward the specific type of animal from which the additive is sourced. Other animal-specific additives, such as target-species blood, may be used in addition to or in lieu of the expressly described example of urine. Also, the urine and water contents listed above can be varied together to vary the scent potency of the product compound. For example, some of the water can be replaced by additional urine to render a more potently scented product.

The konjac root glucomannan and refined kappa carrageenan are advantageous as ingredients in lieu of, for example, animal-sourced gelatin. The glucomannan and carrageenan are all natural products and are odorless, so as to result in a product compound scented essentially only by the specific animal-sourced additive (of which urine is indicated above as a particular example) as intended. Furthermore, a gelatin based scented product tends to be short-lived once exposed to outdoor conditions. For example, a gelatin-based product may only last several days, which would require a hunter to replenish a scented area frequently. Scented compounds within the scope of these descriptions instead including glucomannan and carrageenan may be viable as an attractant for several weeks once removed from packaging and exposes to outdoor conditions. A hunter, for example, can make fewer visits to the immediate location of a scented area such as a mock scrape and is thus unlikely to disturb that immediate area with his or her presence and scent thereby inadvertently alerting prey.

A method 100 of making a scented compound, according to at least one embodiment, particularly with the above listing of ingredients, is represented by a flowchart in FIG. 1. The powder and liquid ingredients are added together after their respective combinations. That is, in step 102, the konjac root glucomannan and kappa carrageenan are combined together while stirring to ensure an even uniformly blended powder mixture. In step 104, the water, urine, and glycerin are combined in a vessel, such as a pot, while stirring at low to medium heat or until the liquid mixture reaches 175 degrees F. Steps 102 and 104 can be done sequentially. For example, step 102 can be completed and the blended powder mixture resulting therefrom can be set aside prior to the initiation of step 104. Alternatively steps 102 and 104 can be conducted in parallel or simultaneously, with the powdered mixture resulting being available for step 106.

In step 106, while stirring the liquid mixture, the powder mixture is added. For example, a sifter can be used above the vessel in which the liquid mixture is heated and stirred to add the powder mixture. In step 108, the liquid mixture and added powder mixture are stirred into a uniform compound while increasing the applied heat to medium to medium high, resulting in a slow boiling compound. In step 110, the boiling compound is covered, for example by a pot lid or other vessel cover.

As the compound continues to boil, visual inspection (step 112) for uniform mixing is occasionally conducted by uncovering the boiling compound. If the compound is observed in step 114 to be not uniformly mixed, represented by "No" from step 114, the mixture is stirred (step 116) to reach uniform mixing as the compound continues to boil, and the boiling compound is again covered while heat is maintained, returning to step 110 in FIG. 1.

If the compound is observed in step 114 to be uniformly mixed, represented by "Yes" from step 114, the color and consistency are observed for resemblance of caramel as represented in step 118 in FIG. 1. If the compound is observed in step 118 to not resemble caramel in color and consistency, represented by "No" from step 118, the boiling compound is again covered while heat is maintained, returning to step 110 in FIG. 1. If the compound is observed in step 118 to resemble caramel in color and consistency, represented by "Yes" from step 118, the compound has reached its product form and is ultimately allowed to cool to room temperature (step 122), for example to 70-80 degrees Fahrenheit (DEG. F).

Prior to full cooling, the hot or warm product compound is soft and formable, and thus can be poured into a mold or otherwise shaped as desired as represented by the optional step 120 intermediate step 118 and step 122 in FIG. 1. Any desired pre-heated standard or uniquely shaped pan, depending on application, can serve as a mold. The above-mentioned vessel in which the liquid mixture is heated and stirred can serve as the mold or standard.

The product compound can furthermore be sliced and packaged, as represented by step 124 in FIG. 1. It is understood that step 120 and step 124 are optional, and vary according to final product shape and unit size preferences. As forming and slicing of the product compound may be more convenient while the product compound is still soft and formable prior to full cooling, optional steps 120 and 124 may precede or follow step 122 in various examples of the method 100 represented in FIG. 1.

The product compound resulting after cooling is semi-rigid and deformable. The compound actively reacts to outside temperature changes, weather variations, and for example, soil, by way of syneresis or "sweating," by which the compound contracts, separates, or otherwise diminishes, resulting in the animal-specific additive, which is urine in the express example, being released over time. When the product compound is sealed in an impermeable container, for example as represented by the sealed airtight package 146 in FIG. 4, its internal moisture is trapped therein and thus evaporation and deterioration are prevented. The product compound will begin to release the animal-specific additive such as urine by sweating once it's released from the packaging and exposed to outdoor conditions. The product compound may last longer with regard to scent-releasing viability in open air conditions, whereas exposure to soil such as in a mock scrape tends to wick and dry the compound. Exposure to excess moisture may tend to dissolve the product compound.

Figure 2:
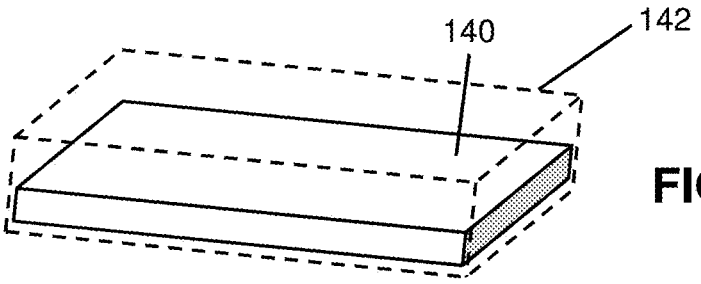
FIG. 2 is a perspective view of a scented compound in a mold or vessel, according to at least one embodiment.
Figure 3:
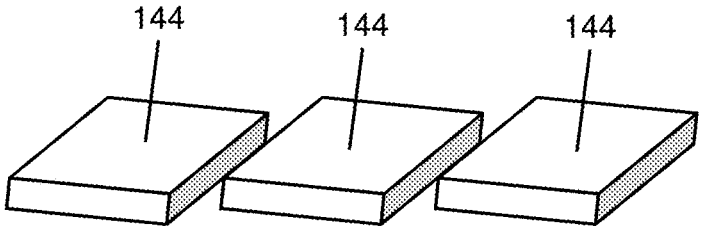
FIG. 3 is a perspective view of the compound of FIG. 2 divided into individual use units.

FIG. 2 is a perspective view of a scented compound 140, for example as prepared in the above description, in a mold or vessel 142 represented in dashed line, according to at least one embodiment. The product compound 140 can be prepared in a batch amount (FIG. 2), and divided into smaller quantities as any desired product compound units 144 (FIG. 3), for example for individual use.

Figure 4:
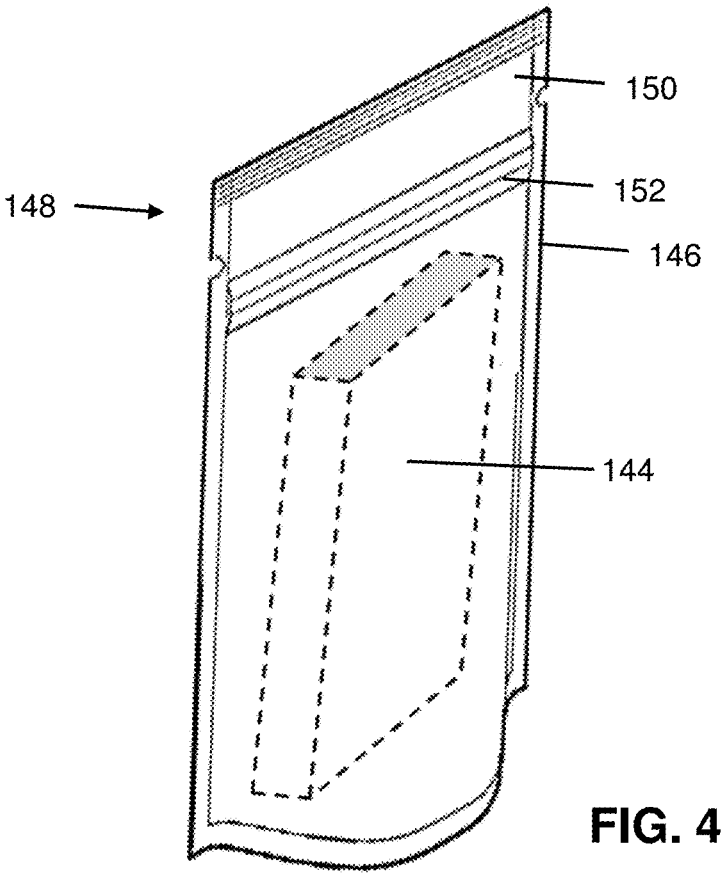
FIG. 4 is a perspective view of a packaged unit of a scented compound, according to at least one embodiment.

A packaged unit 148 is shown in FIG. 4, in which a unit 144 of animal-scented compound is shown in dashed line within a sealed airtight package 146. The package is illustrated as having a tearable top margin 150 and a resealable closure 152 below the margin.

Figure 5:
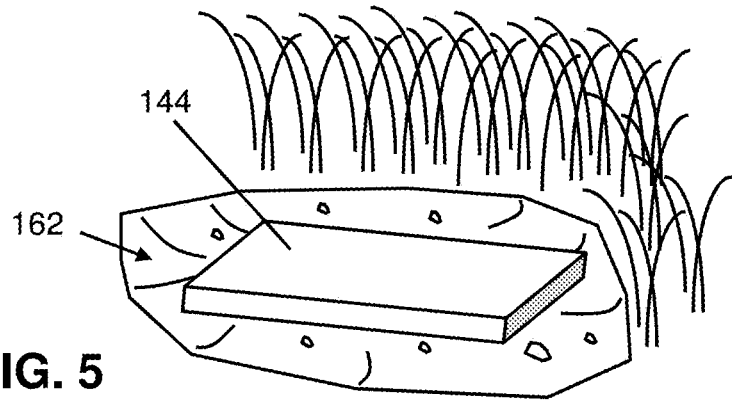
FIG. 5 is a perspective view of a mock scrape being prepared with a scented compound, according to at least one embodiment.
Figure 6:
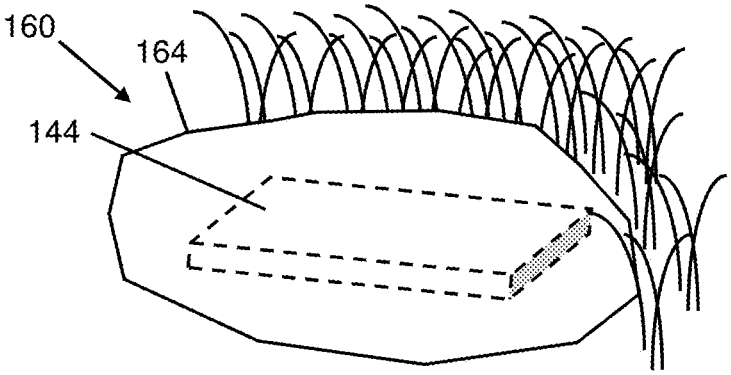
FIG. 6 is a perspective view of the mock scrape of FIG. 5 with the animal-scented compound covered, according to at least one embodiment.

FIG. 5 is a perspective view of a mock scrape 160 being prepared with a scented compound, according to at least one embodiment. To prepare a mock scrape 160, a bare or slightly excavated patch 162 of ground is prepared, for example by hand, by use of a tool or stick, or even using a boot or other shoe. To mimic a target-species animal, which typically urinates on an exposed soil area to leave its scent, a unit 144 of animal-scented compound is placed in the patch 162 of ground. As shown in FIG. 6, the unit 144 is then covered with soil or other natural debris 164, such as that used to expose or excavate the patch 162 (FIG. 5) to complete the mock scrape 160. The illustrated example may be intended as a mock scrape of, for example, a white-tail buck. In such an example, the animal-specific additive used in the making of the animal-scented compound can be the urine of a white tail buck.

Figure 7:
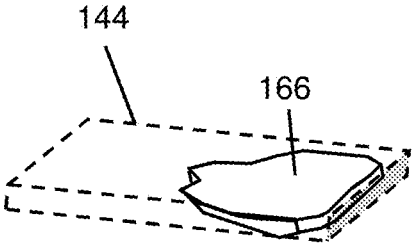
FIG. 7 is a perspective view of a unit of an animal-scent targeted compound unit diminished by exposure for comparison to FIGS. 5 and 6.

Due to exposure in the mock scrape 160 of FIG. 6 in natural outdoor conditions, the product compound unit 144 diminishes as represented by the remaining portion 166 in FIG. 7. The diminishing of the unit results in the animal-specific additive, which is urine in the express example, being released over time, thereby scenting the area with an animal-specific scent of a target animal.

Figure 8:
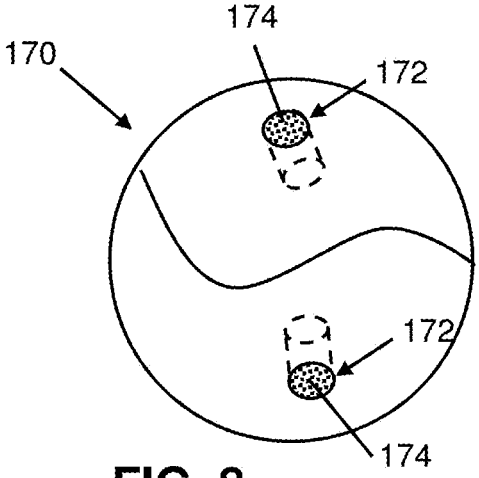
FIG. 8 a perspective view of a scented compound loaded device, according to at least one embodiment, for training hunting animals.

FIG. 8 a perspective view of a scented compound loaded training device, according to at least one embodiment. The device 170 is illustrated as a ball, for example, for dog training purposes. Holes 172 formed in the surface of the device are filled with a scented compound, for example plugs 174 of the product compound 140.

According to the example of FIG. 8 and other examples within the scope of these descriptions or that will come to mind in view of these descriptions, a scented compound can be used as part of or to form training devices such as plugs, balls or other suitable shapes for the purpose of training hunting animals, where the desired effects of all natural syneresis would be advantageous. In use, such a device will release animal scent to its environment by syneresis and can thus be used to train a hunting animal to find or track the device according to the scent, thus training the animal to find or track the target animal. The training device can be wetted to promote sweating of the animal-sourced additive, releasing micro-droplets that in turn mark an active tracking trail by scent wherever the ball was rolled, thrown or bounced. The use of all-natural ingredients provides a safe compound in the event the compound is ingested. Additionally, the use of all-natural ingredients in the product compound, of which all but the specific animal-sourced additive are odorless, prevents undesirable animal scents from being unintentionally introduced during training. The above described scented compound and its ingredients are free of gelatin. Gelatin is a collagen taken from animal body parts, and thus unwanted scents can originate from the use of a compound utilizing gelatin or other animal byproduct-based compounds.

Particular embodiments and features have been described with reference to the drawings. It is to be understood that these descriptions are not limited to any single embodiment or any particular set of features, and that similar embodiments and features may arise or modifications and additions may be made without departing from the scope of these descriptions and the spirit of the appended claims.

What is claimed is:

1. A product comprising a scented compound configured to release a scent of a target animal, the scented compound comprising:

glucomannan;

carrageenan;

water;

an animal-sourced additive comprising urine; and glycerin.

2. The product of claim 1, wherein the scented compound, when exposed to additional moisture, undergoes syneresis thereby releasing at least a portion of the animal-sourced additive.

3. The product of claim 1, wherein the animal-sourced additive is the only animal-sourced ingredient of the scented compound.

4. The product of claim 1, wherein the scented compound does not contain gelatin.

5. The product of claim 1, wherein the animal-sourced additive further comprises blood.

6. The product of claim 1, further comprising a ball into which the scented compound is loaded.

7. A method of making a scented compound, the method comprising:

combining glucomannan, carrageenan, water, an animal-sourced additive comprising urine, and glycerin.

8. The method of claim 7, wherein combining glucomannan, carrageenan, water, an animal-sourced additive, and glycerin comprises:

combining glucomannan and carrageenan to form a powder mixture;

combining and heating water, animal-sourced additive, and glycerin to form a heated liquid mixture; and combining the powder mixture and heated the liquid mixture to form a heated compound.

9. The method of claim 8, further comprising mixing the heated compound to uniformity.

10. The method of claim 9, further comprising heating until the heated compound is viscous and uniformly colored.

11. The method of claim 9, wherein the heated compound comprises:

about 5 to 7 parts by volume konjac root glucomannan;

about 8 to 10 parts by volume refined kappa carrageenan;

about 46 to 48 parts by volume water;

about 3-25 parts by volume urine; and about 13-15 parts by volume glycerine.

12. The method of claim 8, further comprising boiling the heated compound.

13. The method of claim 8, further comprising cooling the heated compound.

14. The method of claim 7, wherein the animal-sourced additive is the only animal-sourced ingredient of the scented compound.

15. The method of claim 7, wherein the scented compound does not contain gelatin.

* * * * *